US006509783B2

(12) United States Patent
Chowdhury

(10) Patent No.: US 6,509,783 B2
(45) Date of Patent: Jan. 21, 2003

(54) GENERATION OF A VOLTAGE PROPORTIONAL TO TEMPERATURE WITH A NEGATIVE VARIATION

(75) Inventor: Vivek Chowdhury, Bracknell (GB)

(73) Assignee: STMicroelectronics Limited

( * ) Notice: Subject to any disclaimer, the term of this patent is extended or adjusted under 35 U.S.C. 154(b) by 0 days.

(21) Appl. No.: 09/853,878

(22) Filed: May 11, 2001

(65) Prior Publication Data

US 2002/0030536 A1 Mar. 14, 2002

(30) Foreign Application Priority Data

May 12, 2000 (GB) ..... 0011541

(51) Int. Cl.[7] ..... H03K 3/42

(52) U.S. Cl. ..... 327/513; 327/512; 327/540; 327/541

(58) Field of Search ..... 327/512, 513, 327/539, 538, 540, 541, 542; 323/312, 313, 314, 316

(56) References Cited

U.S. PATENT DOCUMENTS

| | | | | |
|---|---|---|---|---|
| 4,525,663 A | | 6/1985 | Henry | 323/280 |
| 4,902,959 A | | 2/1990 | Brokaw | 327/314 |
| 5,352,973 A | | 10/1994 | Audy | 323/6 |
| 5,519,354 A | | 5/1996 | Audy | 327/512 |
| 5,686,821 A | | 11/1997 | Brokaw | 323/273 |
| 5,982,162 A | * | 11/1999 | Yamauchi | 323/316 |
| 6,028,478 A | | 2/2000 | Seremeta et al. | 330/252 |
| 6,037,833 A | | 3/2000 | Ang | 327/543 |
| 6,064,275 A | * | 5/2000 | Yamauchi | 331/57 |
| 6,087,812 A | * | 7/2000 | Tobita | 323/280 |

FOREIGN PATENT DOCUMENTS

DE 42 24 584 A 1/1994

OTHER PUBLICATIONS

Standard Search Report from United Kingdom application No. 011541.

* cited by examiner

*Primary Examiner*—Tuan T. Lam
*Assistant Examiner*—Hiep Nguyen
(74) *Attorney, Agent, or Firm*—Wolf, Greenfield & Sacks, P.C.; James H. Morris; Robert A. Skrivanek, Jr.

(57) ABSTRACT

A circuit for generating an output voltage proportional to temperature with a required gradient, the circuit including a first stage arranged to generate a first voltage which is proportional to temperature with a predetermined gradient but has a positive value when the temperature falls below zero and a second stage connected to the first stage and including a differential amplifier having a first input connected to receive the first voltage and a second input connected to receive a feedback voltage which is derived from an output signal of the differential amplifier via an offset circuit which introduces an offset voltage such that the output signal of the differential amplifier provides at an output node the output voltage which has a negative variation with negative temperatures.

9 Claims, 4 Drawing Sheets

GENERATION OF A VOLTAGE PROPORTIONAL TO TEMPERATURE WITH A NEGATIVE VARIATION

The present invention relates to a circuit for generating an output voltage which is proportional to temperature with a required gradient.

Such circuits exist which rely on the principle that the difference in the base emitter voltage of two bipolar transistors with differing areas, if appropriately connected, can result in a current which has a positive temperature coefficient, that is a current which varies linearly with temperature such that as the temperature increases the current increases. This current, referred to herein as Iptat, can be used to generate a voltage proportional to absolute temperature, Vptat, when supplied across a resistor.

Although this principle is sound, a number of difficulties exist in converting this principle to practical applications. One such difficulty is that, in existing circuits, the voltage which is generated remains positive even when the temperature undergoes negative variations, that is temperature variations below 0° C. This means it is not possible to generate a Vptat which directly maps the temperature.

It is an aim of the present invention to provide a circuit which will allow the voltage proportional to temperature to vary negatively with negative temperatures.

The present invention provides a circuit for generating an output voltage proportional to temperature with a required gradient, the circuit comprising: a first stage arranged to generate a first voltage which is proportional to temperature with a predetermined gradient but which has a positive value when the temperature falls below zero; and a second stage connected to the first stage and comprising a differential amplifier having a first input connected to receive the first voltage and a second input connected to receive a feedback voltage which is derived from an output signal of the differential amplifier via an offset circuit which introduces an offset voltage such that the output signal of the differential amplifier provides at an output node said output voltage which has a negative variation with negative temperatures.

For a better understanding of the present invention and to show how the same may be carried into effect reference will now be made by way of example to the accompanying drawings in which.

The present invention is concerned with a circuit for the generation of a voltage proportional to absolute temperature (Vptat). The circuit has two stages which are referred to herein as the first stage and the second stage. In the first stage, a "raw" voltage Vptat is generated, and in the second stage a calibrated voltage for measurement purposes is generated from the "raw" voltage.

Figure 1:
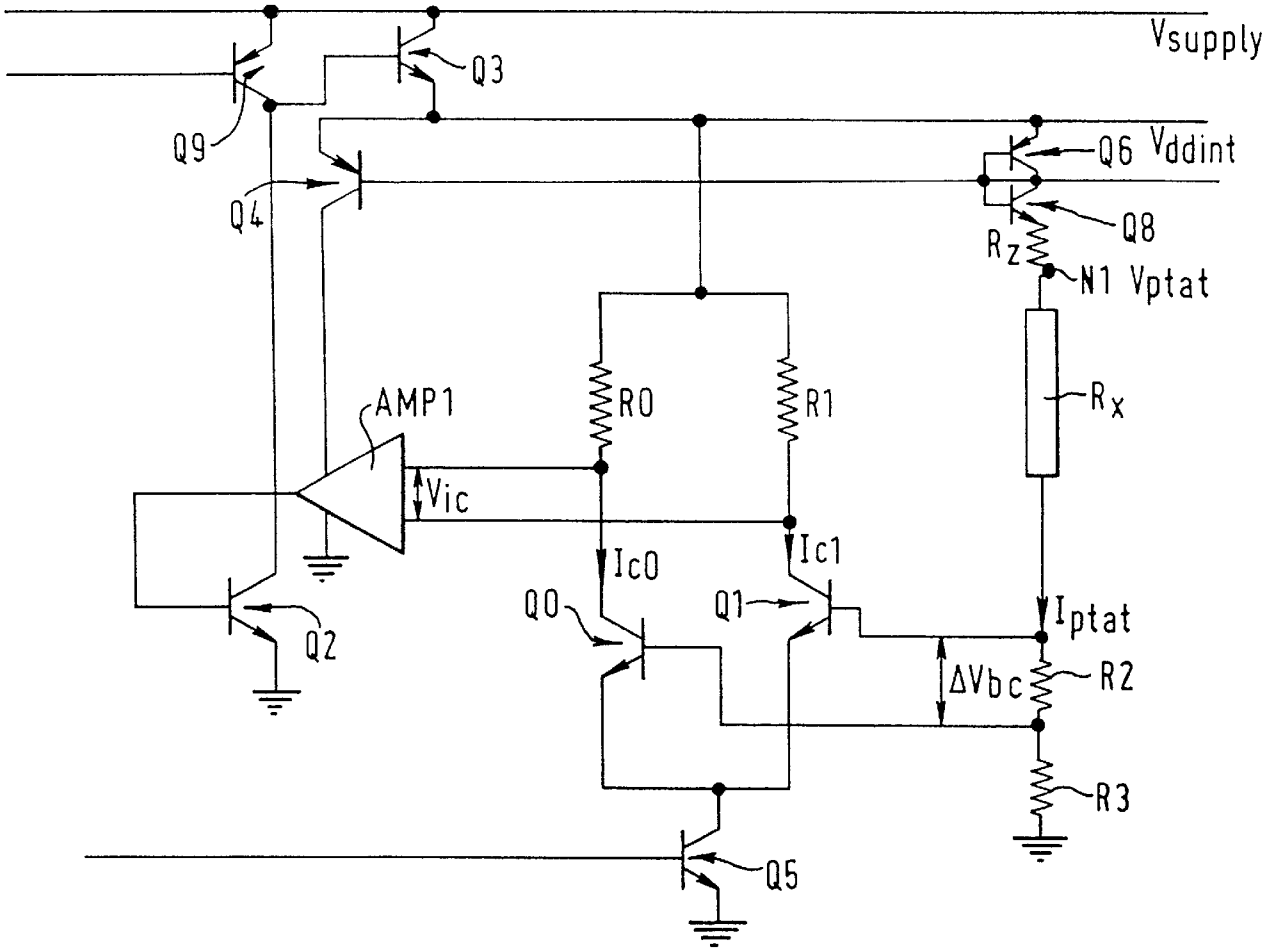
FIG. 1 represents circuitry of the first stage.

FIG. 1 illustrates one embodiment of the first stage. The core of the voltage generation circuit comprises two bipolar transistors Q0,Q1 which have different emitter areas. The difference ΔVbe between the base emitter voltages Vb(Q1)−Vb(Q0) is given to the first order by the equation (1):

$$\Delta Vbe = \frac{KT}{q} \cdot \ln \frac{Ic_1 Is_0}{Ic_0 Is_1} \tag{1}$$

where K is Boltzmanns constant, T is temperature, q is the electron charge, $Ic_0$ is the collector current through the transistor Q0, $Ic_1$, is the collector current through the transistor Q1, $Is_0$ is the saturation current of the transistor Q0 and $Is_1$ is the saturation current of the transistor Q1. As is well known, the saturation current is dependent on the emitter area, such that the ratio $Is_0$ divided by $Is_1$ is equal to the ratio of the emitter area of the transistor Q0 to the emitter area of the transistor Q1. In the described embodiment, that ratio is 8. Also, the circuit illustrated in FIG. 1, is arranged so that the collector currents $Ic_1$ and $Ic_0$ are maintained equal, such that their ratio is 1, as discussed in more detail in the following. Therefore, to a first approximation, $$\Delta Vbe = \frac{KT}{q} \cdot \ln 8 \tag{1a}$$

The difference ΔVbe is dropped across a bridge resistor R2 to generate a current proportional to absolute temperature Iptat, where:

$$Iptat = \frac{\Delta Vbe}{R2} \tag{2}$$

This current Iptat is passed through a resistive chain Rx to generate the temperature dependent voltage Vptat at a node N1. A resistor R3 is connected between R2 and ground.

With R2 equal to 18 kOhms, substituting the values in equations (1) and (2) above, Iptat is in the range 2.5 μA to 3 μA over a temperature range of −20 to 100° C. The temperature dependent voltage Vptat is given by:

$$Vptat = Iptat \times (R2 + R3 + Rx) = \frac{KT \ln 8}{q} \frac{(R2 + R3 + Rx)}{R2} \tag{3}$$

To get a relationship of the temperature dependent voltage Vptat variation with temperature, we differentiate the above equation to obtain:

$$\frac{dVptat}{dT} = K \ln 8 \frac{(R2 + R3 + Rx)}{q \times R2} \tag{4}$$

With the values indicated above R2=18K, R3=36K, Rx=85K, the variation of voltage with temperature is 4.53 mV/°C.

Before discussing how Vptat is modified in the second stage, other attributes of the circuit of the first stage will be discussed.

The collector currents $Ic_1$, $Ic_0$ are forced to be equal by matching resistors R0, R1 in the collector paths as closely as possible. However, it is also important to maintain the collector voltages of the transistors Q0,Q1 as close to one another as possible to match the collector currents. This is achieved by connecting the two inputs of a differential amplifier AMP1 to the respective collector paths. The amplifier AMP1 is designed to hold its inputs very close to one another. In the described embodiments, the input voltage Vio of the amplifier AMP1 is less then 1 mV so that the matching of the collector voltages of the transistors Q0,Q1 is very good. This improves the linearity of operation of the circuit.

Vddint denotes an internal line voltage which is set and stabilised as described in the following. A transistor Q4 has its emitter connected to $V_{ddint}$ and its collector connected to the amplifier AMP1 to act as a current source for the amplifier AMP1. It is connected in a mirror configuration with a bipolar transistor Q6 which has its base connected to its collector. The transistor Q6 is connected in series to an opposite polarity transistor Q8, also having its base connected to its collector.

The bipolar transistors Q8 and Q6 assist in setting the value of the internal line voltage $V_{ddint}$ at a stable voltage to a level given by, to a first approximation, $$V_{ddint}=Iptat(R3+R2+Rx+Rz)+Vbe(Q6)+Vbe(Q8) \quad (5)$$

According to the principal on which bandgap voltage regulators are based, as Vptat increases with temperature, the Vbe of transistors Q6 and Q8 decrease due to the temperature dependence of Vbe in a bipolar transistor. Thus, $V_{ddint}$ is a reasonably stable voltage because the decrease across Q6 and Q8 with rising temperature is compensated by the increase in Vptat.

The amplifier AMP1 has a secondary purpose, provided at no extra overhead, to the main purpose of equalising the collector voltages Q0 and Q1, discussed above. The secondary use is for stabilising the line voltage $V_{ddint}$. Imagine if $V_{ddint}$ is disturbed by fluctuating voltage or current due to excessive current taken from the second stage (discussed later) or noise or power supply coupling onto it. The voltage on line $V_{ddint}$ will go up or down slightly. If $V_{ddint}$ goes higher, then the potential at resistor R2 and R3 will rise. Ic1 will increase slightly more than Ic0 and the difference across AMP1 increases. AMP1 is a transconductance amplifier and as the Vic increases more current is drawn through Q2, i. e. Ic2 increases. Q3 is starved of base current and switches off allowing $V_{ddint}$ to recover by current discharge through the resistor bridge. The opposite occurs when $V_{ddint}$ goes low in which case AMP1 supplies less current to the base of Q2 therefore the current Ic2 decreases and more current from Q9 can go to the base of Q3 allowing more drive current Ic3 to supply $V_{ddint}$. In effect there is some stabilisation.

The base of a transistor Q9 connected between the transistor Q2 and $V_{supply}$ is connected to receive a start-up signal from a start-up circuit (not shown). The transistor Q9 acts as a current source for the transistor Q2. An additional bipolar transistor Q5 is connected between the common emitter connection of the voltage generating transistors Q0,Q1 and has its base connected to receive a start-up signal from the start-up circuit. It functions as the "tail" of the Vptat transistors Q0,Q1.

The temperature dependent voltage Vptat generated by the first stage illustrated in FIG. 1 has a good linear variation at the calculated slope ≈4.53 mV/°C. However, the internal line voltage $V_{ddint}$ limits the swing in the upper direction, and also Vptat cannot go down to zero.

Figure 2:
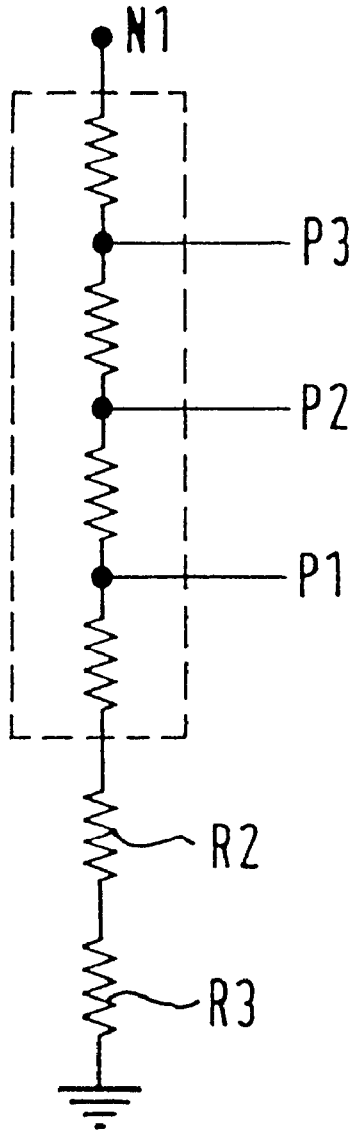
FIG. 2 represents construction of a resistive chain.

It will be appreciated that the resistive chain Rx constitutes a sequence of resistors connected in series as illustrated for example in FIG. 2. The slope of the temperature dependent voltage is dependent on the resistive value in the resistive chain Rx and thus can be altered by tapping off the voltage at different points P1, P2, P3 in FIG. 2.

Figure 3:
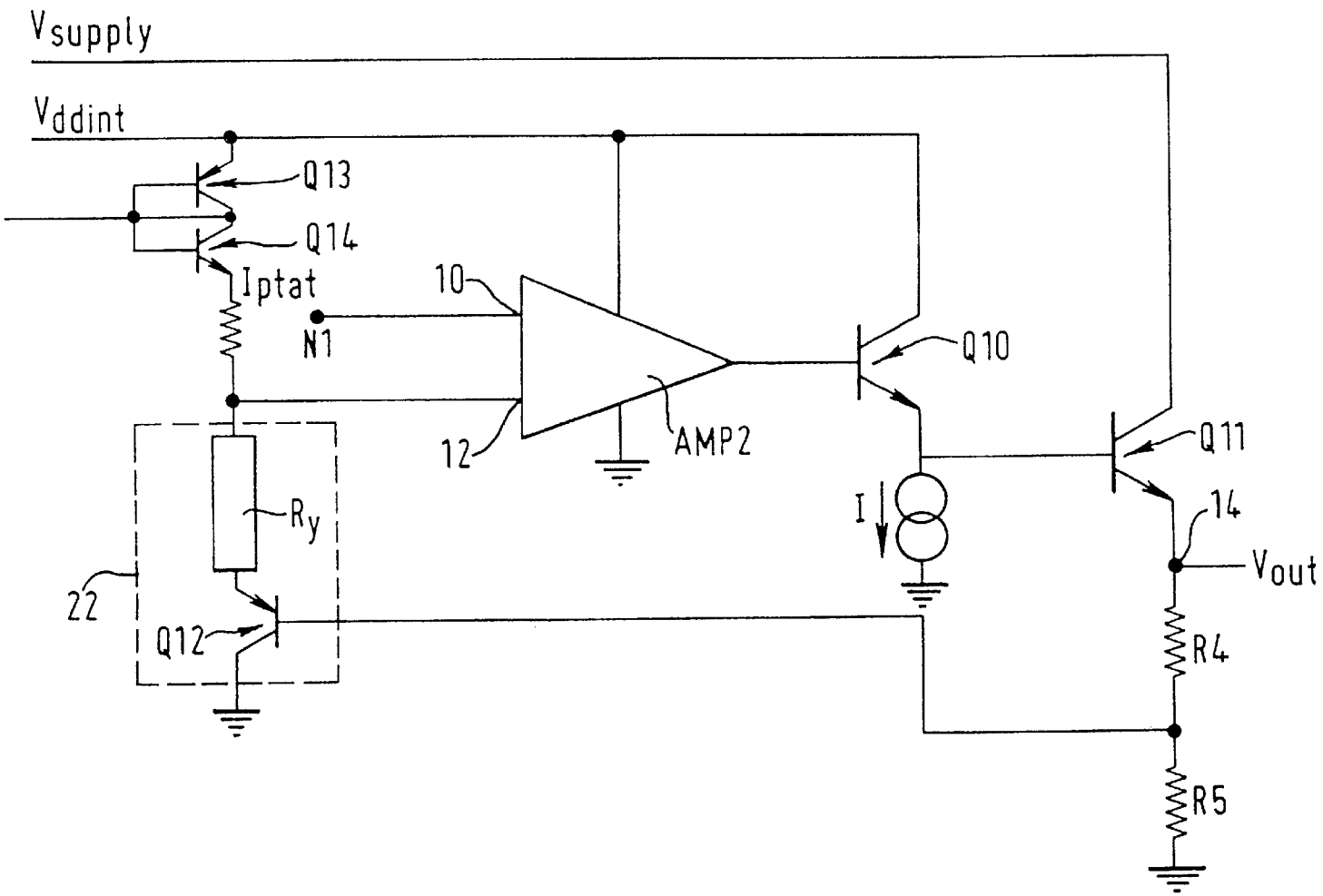
FIG. 3 represents circuitry of the second stage.

FIG. 3 illustrates the second stage of the circuit which functions as a gain stage. The circuit comprises a differential amplifier AMP2 having a first input 10 connected to receive the temperature dependent voltage Vptat at node N1 from the first stage and a second input 12 serving as a feedback input. The output of the differential amplifier AMP2 is connected to a Darlington pair of transistors Q10, Q11. The emitter of the second transistor Q11 in the Darlington pair supplies an output voltage Vout at node 14. The amplifier AMP2 and the first Darlington transistor Q10 are connected to the stable voltage line $V_{ddint}$ supplied by the first stage. The second Darlington transistor is connected to $V_{supply}$.

The output voltage Vout is a voltage which is proportional to temperature with a required gradient and which can move negative with negative temperatures. The adjustment of the slope of the temperature versus voltage curve is achieved in the second stage by a feedback loop for the differential amplifier AMP2. The feedback loop comprises a gain resistor R4 connected between the output terminal 14 at which the output voltage Vout is taken and the base of a feedback transistor Q12. The collector of the feedback transistor Q12 is connected to ground and its emitter is connected into a resistive chain Ry, the value of which can be altered and which is constructed similarly to the resistive chain Rx in FIG. 2. A resistor R5 is connected between the resistor R4 and ground. The gain of the feedback loop including differential amplifier AMP2 can be adjusted by altering the ratio:

$$\frac{R4+R5}{R5} \quad (6)$$

Figure 4:
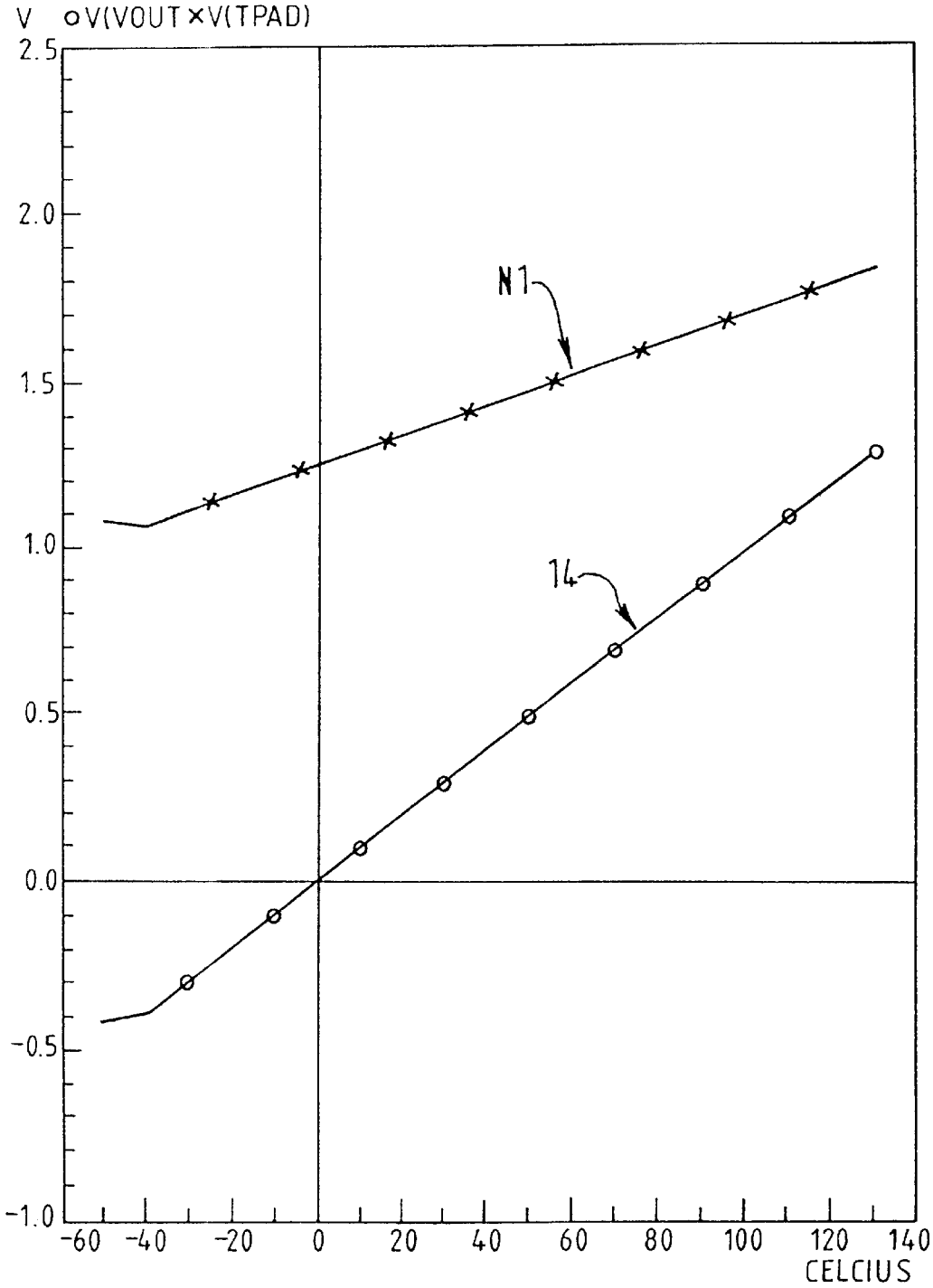
FIG. 4 is a graph illustrating the variation of temperature with voltage for circuits with and without use of the present invention.

This allows the slope of the incoming temperature dependent voltage Vptat to be adjusted between the gradient produced by the first stage at N1 and the required gradient at the output terminal 14. In the described example, the slope of the temperature dependent voltage Vptat at N1 with respect to temperature is 4.53 mV/°C. This is altered by the second stage to 10 mV/°C. This is illustrated in FIG. 4 where the crosses denote the relationship of voltage and temperature at N1 and the diamonds denote the relationship of voltage to temperature for the output voltage at the output node 14.

As has already been mentioned, the voltage Vptat at the node N1 cannot move into negative values even when the temperature moves negative. The second stage of the circuit accomplishes this by providing an offset circuit 22 connected to the input terminal 12 of the differential amplifier AMP2. The offset circuit 22 comprises the resistor chain Ry and the transistor Q12. Together these components provide a relatively stable bandgap voltage of about 1.25 V. The resistive chain Ry receives the current Iptat mirrored from the first stage via two bipolar transistors Q13, Q14 of opposite types which are connected in opposition and which cooperate with the transistors Q6 and Q8 of the first stage to act as a current mirror to mirror the temperature dependent current Iptat. As Iptat increases with temperature, Vbe(Q12) decreases. This offset circuit 22 introduces a fixed voltage offset at the input terminal 12, thus shifting the line of voltage with respect to temperature. This shift can be seen in FIG. 4, where the curve of the output voltage Vout at node 14 can be seen to pass through zero and move negative at negative temperatures.

From the above description it can be seen that the "bridge" network in the first stage performs a number of different functions, as follows. Firstly, it provides a temperature related voltage Vptat at the node N1. Secondly, it assists in providing a relatively fixed internal supply voltage $V_{ddint}$ even in the face of external supply variations, thus giving good line regulation for the gain circuit of the second stage. Thirdly, it provides in conjunction with the current mirror transistors Q4, Q6. current biasing for the amplifier AMP1 of the first stage. Fourthly, it provides, through the mirroring of transistors Q6, Q13 current biasing for the resistive chain Ry in the offset circuit 22 of the second stage.

Table 1 illustrates the operating parameters of one particular embodiment of the circuit. To achieve the operating parameters given in Table 1, adjustment can be made using the resistive chain Rx implemented in the manner illustrated in FIG. 2 to adjust the slope of Vptat in the first stage. Alternatively, the slope may be adjusted in the second stage by altering the gain resistors R4, R5.

TABLE 1

| Parameter | Conditions | Min | Typ | Max | Units |
|---|---|---|---|---|---|
| Accuracy | T = 25 C<br>−30 < T < 130 C | | | +/−2 | deg C |
| Sensor Gain | −30 < T < 130 C | | 10 | | mv/deg C |
| Load Regulation | 0 < lout < 1 mA | | | 15 | mV/mA |
| Line Regulation | 4.0 < VCC < 11 V | | | +/−0.5 | mV/V |
| Quiescent current | 4.0 < VCC < 11 V<br>T = 25 C | | | 80 | uA |
| Operating supply range | | 4 | | 11 | V |
| Output voltage offset | | | 0 | | V |

What is claimed is:

1. A circuit for generating an output voltage proportional to temperature with a required gradient, the circuit comprising:

a first stage arranged to generate a first voltage which is proportional to temperature with a predetermined gradient but which has a positive value when the temperature falls below zero; and a second stage connected to the first stage and comprising a differential amplifier having a first input connected to receive the first voltage and a second input connected to receive a feedback voltage which is derived from an output signal of the differential amplifier via an offset circuit which introduces an offset voltage such that the output signal of the differential amplifier provides at an output node said output voltage which has a negative variation with negative temperatures.

2. A circuit according to claim 1, wherein the first voltage is generated in the first stage by supplying a temperature dependent current through a first resistive element.

3. A circuit according to claim 2, wherein the offset circuit comprises a bipolar transistor connected in series with a second resistive element, the temperature dependent current of the first stage being mirrored into the second resistive element via a current mirror circuit to thereby generate said offset voltage which is stabilised according to a bandgap effect.

4. A circuit according to claim 2 or 3, wherein first and second gain resistors are connected between the output node and a fixed voltage level, wherein the offset circuit is connected between a junction node of said gain resistors and said second input of the differential amplifier.

5. A circuit according to claim 4, wherein the predetermined gradient is altered in the second stage in dependence on the ratio of the sum of the first and second gain resistors to the second gain resistor to match the required gradient.

6. A circuit according to claim 4, wherein the predetermined gradient is the required gradient.

7. A circuit according to claim 4, wherein the first stage includes circuitry for generating a stable internal line voltage notwithstanding variations in a supply voltage, said internal line voltage being used to supply the differential amplifier of the second stage.

8. A circuit according to any of claim 1, 2 or 3, wherein the predetermined gradient is the required gradient.

9. A circuit according to any of claim 1, 2 or 3, wherein the first stage includes circuitry for generating a stable internal line voltage notwithstanding variations in a supply voltage, said internal line voltage being used to supply the differential amplifier of the second stage.

* * * * *